US005402540A

United States Patent [19]

Williams

[11] Patent Number: 5,402,540

[45] Date of Patent: Apr. 4, 1995

[54] WATERPROOF, BREATHABLE ARTICLES OF APPAREL

[76] Inventor: Cole Williams, 2408 Allanjay Pl., Glendale, Calif. 91208

[21] Appl. No.: 72,975

[22] Filed: Jun. 4, 1993

Related U.S. Application Data

[63] Continuation-in-part of Ser. No. 959,115, Oct. 9, 1992.

[51] Int. Cl.[6] ..... A41B 11/00

[52] U.S. Cl. ..... 2/239; 2/243.1; 36/4; 36/9 R; 36/10; 12/142 G; 156/212; 264/222

[58] Field of Search ..... 2/239, 409, 87, 243.1, 2/159, 158, 161.7, 167, 164; 156/212, 213, 306.6, 308.2, 309.6, 322, 292, 290, 148; 264/222; 36/4, 9 R, 10; 12/142 G

[56] References Cited

U.S. PATENT DOCUMENTS

| | | | |
|---|---|---|---|
| 4,194,041 | 3/1980 | Gore et al. | 2/87 |
| 4,310,373 | 1/1982 | Schuhmacher et al. | 2/87 |
| 4,679,257 | 7/1987 | Town | 2/159 |
| 4,809,447 | 3/1989 | Pacanowsky et al. | 2/239 |
| 4,845,862 | 7/1989 | Phillips, Jr. et al. | 36/10 |
| 4,967,494 | 11/1990 | Johnson | 36/9 R |

*Primary Examiner*—Clifford D. Crowder
*Assistant Examiner*—Glona Hale
*Attorney, Agent, or Firm*—J. E. Brunton

[57] ABSTRACT

A footwear article and the method of making the same which will allow water vapor due to perspiration to transpire through the article but will prevent liquid water from external sources from reaching the wearer's foot. One form of the footwear article of the invention comprises a sock which is of three-ply construction with the inside and outside plies being knit and the intermediate ply being made from an elastomeric polyurethane film. The three plies are uniquely bonded together using a pliant, waterproof adhesive.

19 Claims, 1 Drawing Sheet

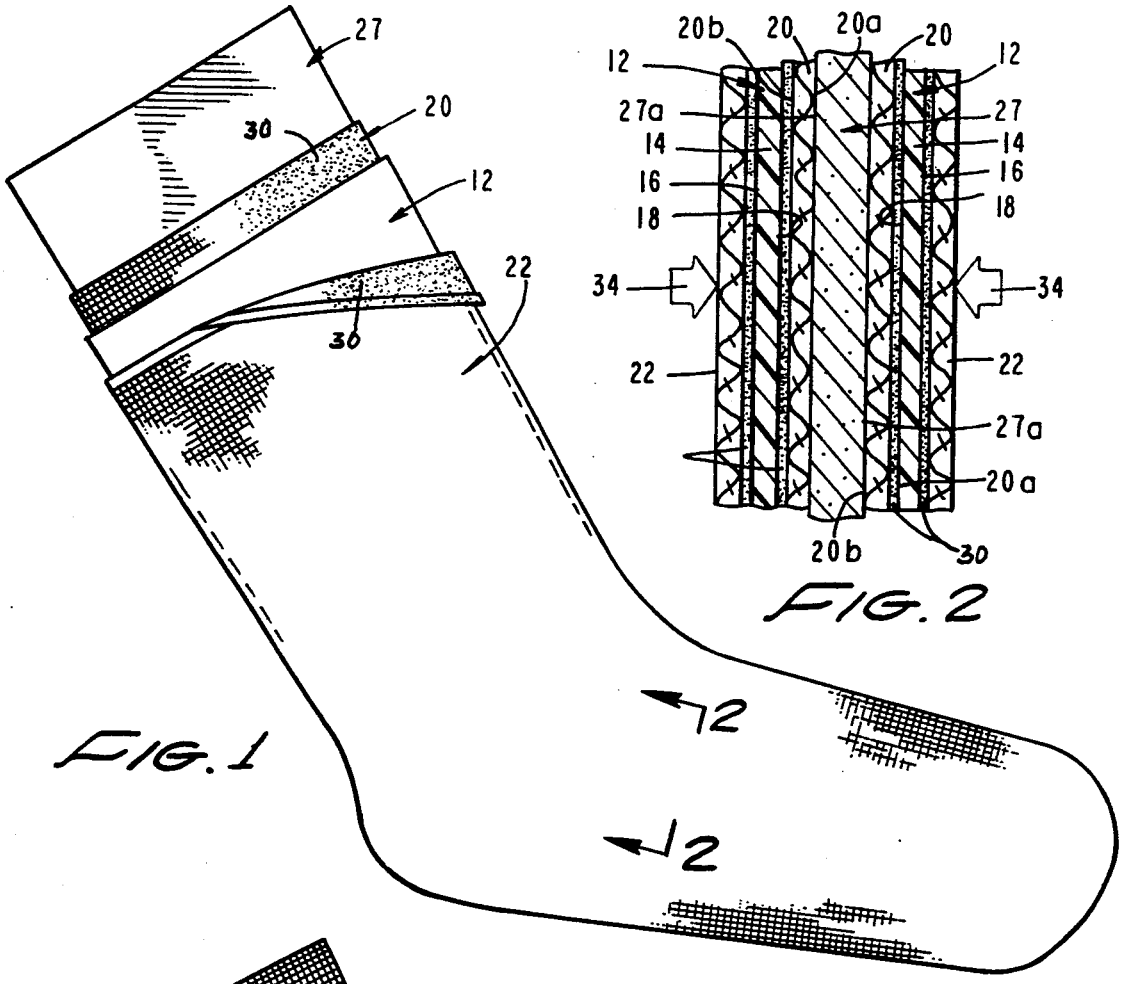
FIG. 1
FIG. 2
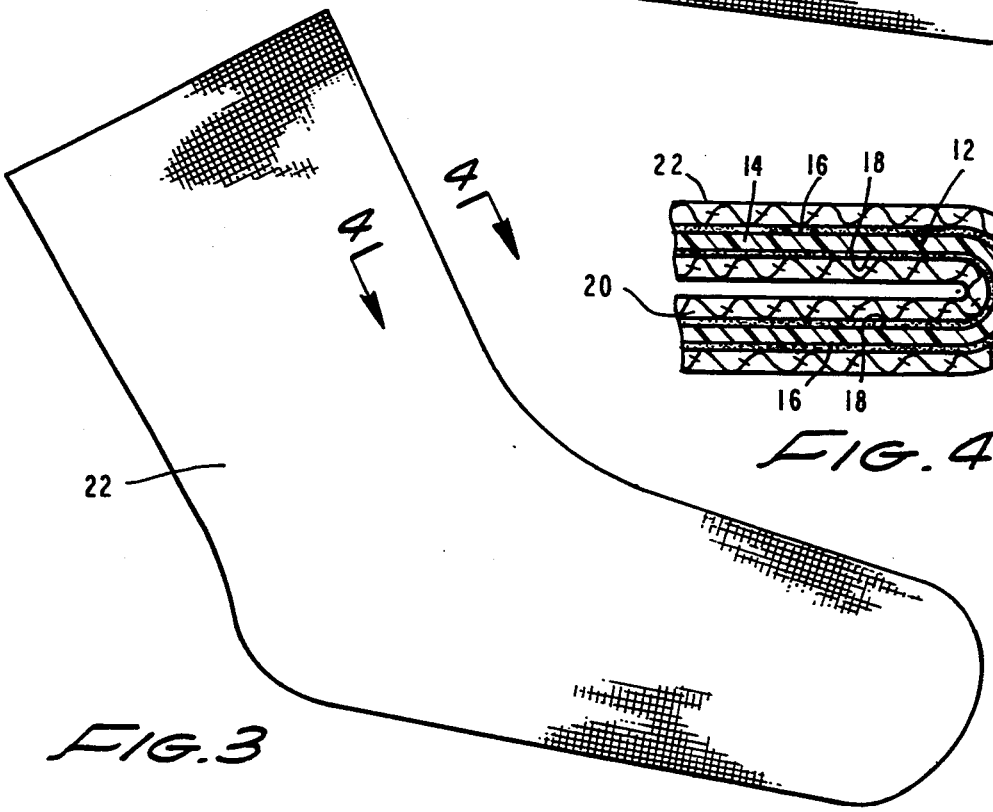
FIG. 3
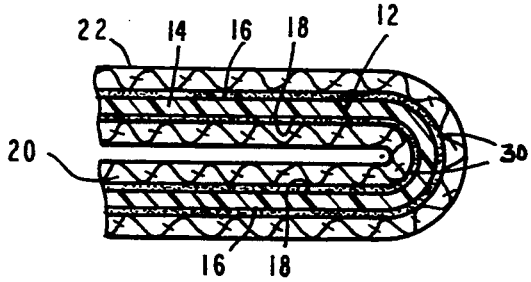
FIG. 4

WATERPROOF, BREATHABLE ARTICLES OF APPAREL

This is a Continuation-In-Part of copending application Ser. No. 07/959,115, filed Oct. 9, 1992.

BACKGROUND OF THE INVENTION

1. Field of the Invention

The present invention relates generally to articles of apparel. More particularly, the invention concerns articles of apparel used to cover the wearer's extremities such as an improved, waterproof sock that will permit perspiration to transpire through the sock, but will keep water from external sources away from the wearer's foot.

2. Discussion of the Invention

Various attempts have been made in the past to produce breathable, waterproof articles of apparel such as gloves and socks that will keep the wearer's hands and feet dry and at the same time permit perspiration to transpire through the article. Materials which will accomplish this desired function have been known for sometime. For example, U.S. Pat. No. 3,953,566 discloses a method of making an expanded polytetrafluoroethylene (PTFE) that possesses the properties of being both breathable and waterproof. An improvement of this material is described in U.S. Pat. No. 4,194,041. While both of these materials have been used in the construction of footwear, they exhibit the drawback that they have limited stretchability, thereby making them less than ideally suited for construction of footwear such as socks. In addition, such footwear typically has sewn seams and tapes which make it bulky and uncomfortable.

In an apparent attempt to overcome the problems discussed in the preceding paragraph, a multi-component sock type article was suggested. This article, which is described in U.S. Pat. No. suggested. This article, which is described in U.S. Pat. No. 4,819,447 issued to Pacanowsky, et al., comprises a waterproof, nonelastic, non-stretch sole component, a non-stretch calf component and a vamp component attached to the sole and calf components.

As will be better appreciated from the discussion which follows, the footwear article of the present invention provides, for the first time, footwear such as socks construction which exhibit the comfort and stretchability of a traditional type of sport sock and at the same time are both breathable and completely waterproof.

SUMMARY OF THE INVENTION

It is an object of the present invention to provide comfortable articles of apparel and the method of making the same which will allow water vapor due to perspiration to transpire through the article but will prevent water from external sources from reaching the wearer's extremities.

A particular object of the invention is to provide a footwear article of the aforementioned character which fits well, is pliant and is durable in use.

Another object of the invention is to provide an article such as a glove or sock in which water vapor from perspiration can be transmitted from inside to outside so that the natural evaporative cooling effect can be achieved.

Another object of the invention is to provide a method of making articles of the character described in the preceding paragraphs which is simple and straight forward, does not require the use of complicated equipment such as sewing and seaming equipment and can be performed by unskilled workmen with a minimum of training.

A particular object of the invention is to provide a sock as described in the preceding paragraphs which is of simple construction and is easy to manufacture.

In its preferred form, the footwear article of the invention comprises a sock which is of three-ply construction with the inside and outside plies being knit and the intermediate ply being made from an elastomeric polyurethane film. The three-plies are uniquely bonded together using a pliant, waterproof adhesive.

BRIEF DESCRIPTION OF THE DRAWINGS

FIG. 1 is a side-elevational view illustrating the method of making the footwear article of the invention and showing the components of the article in position over a foot-shaped planar mandrel.

FIG. 2 is an enlarged cross-sectional view taken along lines 2—2 of FIG. 1.

FIG. 3 is a side-elevational view of one form of the footwear article of the invention.

FIG. 4 is an enlarged cross-sectional view taken along lines 4—4 of FIG. 3.

DESCRIPTION OF THE INVENTION

In the description which follows:

The term "breathable" means the ability of an article to transport interior moisture vapor to the external environment.

As used herein, the term "waterproof" means the ability of an article to substantially prevent liquid water from external sources from reaching the interior of the article.

Similarly, the term "fabric" as used herein means a sheet structure made from fibers, filaments or yarns. Non-limiting examples include woven or nonwoven sheets made by weaving, knitting, felting, hydroentangling or meltblowing fibers, filaments or yarns.

The term "sock" as used herein means a short, close-fitting covering for the foot and lower leg constructed from any suitable material such as natural and synthetic fibers.

Referring to the drawings, FIGS. 3 and 4 show one form of the clothing article of the present invention. The article here comprises a sock construction including a thin, pliant bladder 14 constructed from a waterproof, breathable material, such as polyurethane sheet. The polyurethane sheet can be of various thickness as, for example, between about 0.5 mils and about 3 mils. Bladder 12 includes a foot portion 14 having an outer surface 16 and an inner surface 18. Bladder 12 has the unique capability of generally conforming to the contours of the human foot so that it can be comfortably worn inside a boot or shoe.

Bonded to the inner surface 18 of the elastomeric bladder is a light-weight covering member such as a fabric inner sock 20 of standard construction which is preferably made from knitted natural or synthetic fibers.

The article of the invention shown in FIG. 3 also includes an outer sock 22 which is bonded to the outer surface of bladder 14. Sock 22 can also be constructed from filament or spun yarns. The sock can also be constructed from natural fibers; such as wool fibers, or from a variety of synthetic fibers such as polyester nylon and combinations thereof.

Socks 20 and 22 are preferably bonded to bladder 14 by means of a waterproof, heat activated adhesive 30. A hot melt adhesive in powder form sold by Bostik, Middleton, Mass., product #5116, a polyester type, has proven satisfactory for this purpose. Other adhesives can, of course, also be used, including breathable adhesives. In any event, the adhesive should be selected and applied in a manner that the breathability of the footwear is not destroyed or substantially reduced.

For certain applications the footwear article of the invention can be constructed by bonding to the bladder only a single inner or outer sock. This two, rather than three-ply construction, can be used in a number of applications in which the three or more ply constructions are too bulky or too expensive.

The thin pliant, thermoplastic material from which the waterproof, breathable bladder will be made is of a character that will prevent penetration of liquid water while at the same time permitting free passage of moisture vapor such as perspiration. This material can be a polyurethane sometimes described as thermoplastic urethane. A suitable material of this type is sold by Fabrite Laminating Corp. of Woodridge, N.J. Other suitable materials include elastomers made from polyesters, copolyesters, polyamides, cellulose derivatives, polyacrylic acid and its hololog, natural or synthetic rubber with hydrophilic impurities, copolyozamides, polyureas, polyelectrolytes, polyphosphates, polyvinylamid, polyvinylalcohol, polyether, and copolymers thereof, polythioether, polythioether-polyether, copolyepichlorohydrin-ether, polysulphosphates, copolyester-ether and derivatives or mixtures thereof.

Considering now the method of the invention, the thin, pliant bladder material is first coated with a light coating of the powdered hot melt adhesive, Bostik #5116. The adhesive particles randomly cover the bladder evenly to a density of about 20% coverage of the surface area. This bladder material with adhesive is then heated to a temperature slightly above the softening point of the adhesive, thereby causing the discrete particles of adhesive to fuse to the surface of the bladder material. In the case of Bostik #5116, the softening point is 268 degrees Fahrenheit. This means is also used to coat particles of adhesive on both sides of the bladder material.

The next step is the construction of the waterproof, breathable bladder. In one form of the method of the invention this is accomplished by overlaying two sheets of the previously described adhesive coated bladder material and to define on the sheets of material a line circumscribing the boundary of the bladder. This done, the sheets of material are heated along the boundary line to a temperature sufficient to sealably bond the sheets together along the boundary line.

The heating-fusion step can be accomplished in several ways well known to those skilled in the art, including using a heated wire or die having the shape of the bladder-boundary. Heating can also be accomplished through the use of well-known radio frequency and ultrasonic welding techniques.

One technique which has proven to be satisfactory in making the footwear of the invention, involves the use of a heated platen press embodying a die having the shape of the outer boundary of the bladders. The die is electrically heated to about 500 degrees Fahrenheit. One of the cooperating platens of the platen press is maintained at room temperature and, is lined with a flexible fabric such as felt. The two sheets of the adhesive-coated bladder material are placed between two sheets of polytetrafluoroethylene coated fiber glass sheets which act as separator material and also allow the heat from the die to penetrate to the film. Appropriate heating of the dies causes the sheets of bladder material to be effectively welded, or sealably joined together along the boundary line to make the sock-shaped bladder. After the welding process, the excess material outside the bladder boundary is manually stripped away and the bladder is removed from the platen press. By these means, a sock-shaped bladder component with discrete particles of hot melt adhesive both inside and outside has been produced.

It is to be noted that the proper application of the adhesive to the inner and outer surfaces of the bladder is critical to the success of the manufacturing process, since, when completed, the sock must be breathable, flexible, pliant and waterproof and it must withstand laundering and physical abuse while being worn. It is to be noted that the adhesives can also be applied to the fabric components as an alternative means of construction.

As illustrated in FIGS. 1 and 2 of the drawings, the next step in the process of the invention is to place the first covering member, or inner sock 20 over a generally foot-shaped, approximately ⅛th inch thick, generally planer mandrel 27. Sock 20, which has inner and outer surfaces **20*a* and 20*b* is placed over the mandrel so that inner surface 20*a* thereof is disposed in engagement with the faces 27*a* of mandrel 27. As previously discussed, sock 20** can be constructed from a variety of materials. However, a sock which is made by Wigwam Mills, Inc. of Sheboygan, Wis. special knit pattern of its standard BK-1188 has proven satisfactory. An alternate inner sock, also made by Wigwam, is intended to impart cold weather comfort to the waterproof footwear article of the present invention depending on the climate encountered. For cold weather comfort, the inner sock can be made utilizing Thermax ® made by E. I. duPont de Nemours and Co. of Wilmington, Del. For warm weather comfort the inner sock can be made utilizing Coolmax ® made by duPont.

After sock 20 has been placed over mandrel 27 and smoothed out so that its inner surface is in close engagement with the faces of the mandrel 27, the bladder 12, which has been adhesive coated with particles of hot melt adhesive inside and outside is carefully placed over the assemblage of sock 20 and mandrel 27. The bladder is smoothed to be in close engagement with the outer surface of sock 20. Outer sock 22 is placed over both the inner sock 20 and the adhesive coated bladder assemblage on mandrel 27.

The precursor assembly comprising first sock 20, the adhesive coated bladder 12 and the second sock 22 is then heated and compressed in the direction of the arrows 34 in FIG. 2 to form mandrel, upon which the precursor assembly is mounted, between two platens which can be controllably heated and urged together. More particularly, the platens are preferably electrically heated to a temperature of about 280 degrees Fahrenheit and are controllably moved into pressural engagement with the precursor assembly by any type of hydraulically actuated pressure imparting assembly of a character well known to those skilled in the art. A commercially available press suitable for carrying out the method of the invention is sold by PHI of the City of Industry, Calif. During this temperature-pressure step, the heat activated adhesive is thereby fused making a permanent, water resistant bond of inner sock 20 to one side of the bladder and the outer sock 22 to the other side of the bladder. The minimum temperature required to activate the Bostik #5116 adhesive is 268 degrees Fahrenheit. Accordingly, a temperature range of between about 270 degrees Fahrenheit and 290 degrees Fahrenheit is preferred.

The precursor assembly is then removed from the press and allowed to cool thoroughly prior to doffing the completed waterproof footwear article from the mandrel.

When removed from the mandrel, the footwear article is generally planar in shape. However, upon inserting the foot into the open cuff of the article, the foot engaging portion of the sock will neatly and smoothly conform to the shape of the wearer's foot.

Depending upon the end use of the article, other commercially available adhesives can also be used in the practice of the method of the invention. By way of example, these include an adhesive sold by Stahl U.S.A. of Peabody, Mass. under the designation UE-4172 and an adhesive sold by Reichhold Chemicals, Inc. under the product code EA 6494. Further, a mixture of the Reichhold EA 6494 and a SOLUCOTE® 1024 adhesive made by Soluol Chemical Co., Inc. can be used for some end product applications.

When the adhesive used is in liquid form it can be sprayed, brushed or otherwise applied to the elastomeric bladder or sock fabric. As previously stated when the adhesive is applied to the bladder it must be applied in the manner, such as a dot matrix coating, which will not degrade the breathability characteristics of the bladder material.

An alternate form of the method of the invention will next be considered. This form of the invention is similar in many respects to the method described in the preceding paragraphs. However, in this latest form of the invention a different powdered adhesive is used and, importantly, the bladder and the outer sock are both wetted with water during the assembly step to expedite the assembly of the members and to improve the integrity of the finished product.

In the practice of this alternate form of the invention, the thin, pliant bladder material or membrane is first coated with a light coating of a powdered hot melt adhesive sold under the name and style of Bostik #5182. The adhesive is uniformly distributed over the membrane material preferably at the rate of about 16.5 grams per square yard and is thermally fused to the membrane in the manner previously described. The second side of the membrane material is similarly coated and fused with Bostik #5182 at a rate of about 16.5 grams per square yard. To develop a properly sealed final lamination, the fusing of the adhesive to the membrane must be done with great care to carefully control the radiant heating of the adhesive coated membrane. Too high a temperature will cause the membrane to melt, while too low a temperature will fail to adequately melt and bond the adhesive particles to the bladder surfaces.

Following the coating of the membrane surfaces with Bostik #5182, the next step in this alternate method of the invention is accomplished by cutting the coated membrane into first and second segments and overlying the first and second segments to form a coated assembly. Next, a line is formed on the coated assembly which circumscribes the boundary of the bladder which generally corresponds to the extremity to be covered, in this case the humall foot. This done, the sheets of material are heated along the boundary line to a temperature sufficient to sealably bond the sheets together along the boundary line.

This heating-fusion step is here accomplished using a heated platen press embodying a die having the shape of the outer boundary of the bladders. The aluminum die is electrically heated to about 530 degrees Fahrenheit. The two sheets of the adhesive coated bladder material are placed between two sheets of polytetrafluoroethylene (said under the mark TEFLON coated fiber glass sheets which act as separator material and also allow the heat from the die to penetrate to the film. Appropriate heating of the dies causes the sheets of bladder material to be effectively welded, or sealably joined together along the boundary line to make the sock-shaped bladder. During the welding step, the assemblage is backed by a ½ inch thick sheet of temperature hardboard and a pressure is exerted on the assemblage sufficient to cleanly pinch off the membrane material surrounding the die.

As illustrated in FIGS. 1 and 2 of the drawings, the next step in the alternate process of the invention is to place the first covering member, or inner sock 20, over a generally foot-shaped, approximately ⅛th inch thick, generally planer mandrel 27. Sock 20, which has inner and outer surfaces, is disposed in engagement with the faces 27*a* of mandrel 27. As previously discussed, sock 20 can be constructed from a variety of materials. Mandrel 27 can also be constructed of various materials but here is formed a sheet of aluminum having a thickness of about 0.032 inches. The edges of the mandrel are smoothed and rounded and preferably coated with a thin strip of TEFLON which may comprise a ½ inch wide strip of pressure sensitive adhesive coated TEFLON tape.

After sock 20 has been placed over mandrel 27 and smoothed out so that its inner surface is in close engagement with the faces of the mandrel 27, the bladder 12, which has been adhesive coated with particles of hot melt adhesive inside and outside is immersed in water causing it to expand slightly. The water saturated, expanded bladder is then carefully placed over the assemblage of sock 20 and mandrel 27. The bladder is smoothed to be in close engagement with the outer surface of sock 20. Outer sock 22 is then also wetted by immersing it in water or otherwise wetting it and is carefully placed over both the inner sock 20 and the adhesive coated bladder assemblage on mandrel 27.

The precursor assembly comprising first sock 20, the adhesive coated bladder 12 and the second sock 22 is then placed between heated platens and heated to about 275 to 325 degrees F for about three to five minutes. Preferably the bottom platen is a rigid sheet of aluminum covered with a ¼ inch thick sheet of about 50 durometer silicone rubber. The heated assemblage is then compressed by substantial compressive force in the direction of the arrows 34 in FIG. 2 to form the finished article.

The compressive forces can be exerted on the heated precursor assembly in various ways such as hydraulically-actuated, pressure-imparting assembly, or press, previously described herein. Alternatively, the compressive forces can be applied by passing the precursor assembly between pressing rollers of a character well known to those skilled in the art. Preferably, a pressure of at least two pounds per square inch is exerted on the precursor assembly for about four minutes. Following the compression step, the precursor assembly is immediately plunged into a bath of cool water for several minutes. This step quenches the adhesive, arresting crystalline growth and thereby providing a more amorphous molecular structure and pliant adhesion. Additionally, the bladder is softened and expanded by the water for ease of removal from the mandrel. The wet sock assemblage is then removed from the mandrel and allowed to dry.

It is to be understood that the method of the invention can be used to produce various articles of clothing such as socks and gloves. Such articles can be made in various sizes and design configurations to fit a wide variety of users.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A method of making an article of apparel used to cover a wearer's extremities comprising the steps of:

(a) constructing a waterproof, breathable, elastomeric bladder having the general shape of the wearer's extremity and including an extremity receiving portion comprising the steps of:

(i) distributing an adhesive over the surfaces of first and second sheets of material, said sheets of material being of a character that will prevent penetration of liquid water while at the same time permitting free passage of moisture vapor such as that resulting from perspiration;

(ii) placing said first sheet over said second sheet to form a coated assembly;

(iii) heating said coated assembly along a boundary line generally corresponding to the shape of the wearer's extremity to a temperature sufficient to sealably bond said first and second sheets together along said boundary line; and (iv) removing from said coated assembly excess material located externally of said boundary line to form said elastomeric bladder;

(b) placing a first fabric member having the general shape of the wearer's extremity over a thin generally planar mandrel having the general shape of the wearer's extremity;

(c) wetting said bladder with water to form a wet, expanded bladder;

(d) placing said wet, expanded bladder over said first fabric member to form a subassembly;

(e) wetting with water a second fabric member having the general shape of the wearer's extremity;

(f) placing said wet second fabric member over said subassembly to form a precursor article;

(g) heating and compressing said precursor article in a manner to urge said first and second fabric members into engagement with said bladder to form a heated precursor article; and (h) cooling said precursor article and removing it from said mandrel.

2. A method as defined in claim 1 in which said adhesive comprises thermosetting powder and in which said method includes the further step of, prior to placing said first sheet over said second sheet, heating said first and second sheets to a temperature sufficient to cause said adhesive to bond to the surfaces of said first and second sheets.

3. A method as defined in claim 2 in which said precursor article is heated during the heating and compressing step to a temperature of between 275 degrees F and 325 degrees F for about three to five minutes to form a heated precursor article.

4. A method as defined in claim 3, wherein cooling of said precursor article is accomplished by immersing said heated precursor article into a cool water bath.

5. A method as defined in claim 3 in which said first and second sheets comprise a polyurethane film.

6. A method as defined in claim 3 in which said first and second sheets comprise urethane.

7. A method as defined in claim 3 in which said first and second members comprise synthetic fibers.

8. A method as defined in claim 3 in which said article of apparel comprises a sock.

9. A method of making an article of footwear comprising the steps of:

(a) constructing a waterproof, breathable, elastomeric bladder having the general shape of the human foot and including a foot receiving portion, said bladder having an outer surface and an inner surface and having the ability to generally conform to the contour of a human foot comprising the steps of:

(i) uniformly distributing an adhesive over the surfaces of a membrane of thermo plastic material of a character that will prevent penetration of liquid water while at the same time permitting free passage of moisture vapor such as that resulting from perspiration to form a coated membrane;

(ii) cutting said coated membrane into first and second segments and overlying said first and second segments to form a coated assembly;

(iii) heating said coated assembly along a boundary line generally corresponding to the shape of the human foot to a temperature sufficient to sealably bond said first and second segments together along said boundary line; and (iv) removing from said coated assembly excess material located externally of said boundary line to form said bladder;

(b) placing a first fabric sock having first and second surfaces over a thin generally foot-shaped planar mandrel with said first surface thereof being located adjacent said mandrel;

(c) wetting said bladder with water to form a wet, expanded bladder;

(d) placing wet expanded said bladder over said first fabric sock adjacent said second surface thereof to form a subassembly;

(e) wetting with water a second fabric sock having a first and second surface;

(f) placing said wet second fabric sock over said subassembly with said first surface thereof in engagement with said bladder to form a precursor article; and (g) simultaneously heating and compressing said precursor article to urge said first and second fabric socks into engagement with said bladder to form a heated precursor article.

10. A method as defined in claim 9 in which said adhesive comprises thermosetting powder and in which said precursor article is heated during the heating and compressing step to a temperature of between 275 degrees F and 325 degrees F to form a heated precursor article.

11. A method as defined in claim 9 including the further step of immersing said heated precursor article into a cool water bath.

12. A method as defined in claim 9 including the further step of removing said first and second socks and said bladder from said mandrel and drying the assemblage to form the article of footwear.

13. A method as defined in claim 9 in which said membrane comprises a polyurethane film.

14. A method as defined in claim 9 in which said membrane comprises a material selected from a group consisting of urethane, polyurethane, and elastomers made from polyester, polyamides, cellulose derivatives and polyacrylic acid.

15. A method of making an article of footware comprising the steps of:

(a) constructing a waterproof, breathable, elastomeric bladder having the general shape of the human foot and including a foot receiving portion, said bladder having an outer surface and an inner surface and having the ability to generally conform to the contour of a human foot comprising the steps of:

(i) uniformly distributing a powdered thermosetting adhesive over the surface of a membrane of thermo plastic material of a character that will prevent penetration of liquid water while at the same time permitting free passage of moisture vapor such as that resulting from perspiration to form a coated membrane;

(ii) heating said membrane to a temperature sufficient to melt said adhesive causing it to bond to said membrane;

(iii) cutting said coated membrane into first and second segments and overlying said first and second segments to form a coated assembly;

(iv) heating said coated assembly along a boundary line generally corresponding to the shape of the human foot to a temperature sufficient to sealably bound said first and second segments together along said boundary line; and (v) removing from said coated assembly excess material located externally of said boundary line to form said bladder;

(b) placing a first fabric sock having first and second surfaces over a thin generally foot-shaped planar mandrel with said first surface thereof being located adjacent said mandrel;

(c) wetting said bladder with water to form a wet, expanded bladder;

(d) placing wet expanded said bladder over said first fabric sock adjacent said second surface thereof to form a subassembly;

(f) placing said wet second fabric sock over said subassembly with said first surface thereof in engagement with said bladder to form a precursor article;

(g) heating said precursor article to a temperature of approximately 300 degrees F and simultaneously compressing said precursor article in a manner to urge said first and second fabric socks into pressural engagement with said bladder to form a heated precursor article;

(h) immersing said heated precursor article into a cool water bath; and (i) removing said first and second socks and said bladder from said mandrel and drying the assemblage to form the article of footwear.

16. A method as defined in claim 15 in which said membrane comprises a material selected from a group consisting of urethane, polyurethane, and elastomers made from polyester, polyamides, cellulose derivatives and polyacrylic acid.

17. A method as defined in claim 15 in which said first and second fabric socks comprise synthetic fibers.

18. A method as defined in claim 15 in which said first and second fabric socks comprise natural fibers.

19. A method as defined in claim 15 in which said adhesive comprises a urethane polymer.

* * * * *